US008095253B2

(12) United States Patent
Kane et al.

(10) Patent No.: US 8,095,253 B2
(45) Date of Patent: Jan. 10, 2012

(54) FUEL EFFICIENCY IMPROVEMENT FOR LOCOMOTIVE CONSISTS

(75) Inventors: Mark Edward Kane, Orange Park, FL (US); John D. Mix, Jacksonville Beach, FL (US); Mark M. Madden, Jacksonville, FL (US)

(73) Assignee: Invensys Rail Corporation, Louisville, KY (US)

( * ) Notice: Subject to any disclaimer, the term of this patent is extended or adjusted under 35 U.S.C. 154(b) by 776 days.

(21) Appl. No.: 12/178,878

(22) Filed: Jul. 24, 2008

(65) Prior Publication Data

US 2010/0019103 A1 Jan. 28, 2010

(51) Int. Cl.
*B61C 17/00* (2006.01)
*B61C 5/00* (2006.01)

(52) U.S. Cl. ..... 701/20; 701/99; 701/123; 246/182 R; 246/186

(58) Field of Classification Search ..... 701/19, 701/20, 29, 123, 99; 105/26.05, 463.1, 48.3, 105/61, 62.1; 702/182, 183; 246/167 R, 246/182 R, 186
See application file for complete search history.

(56) References Cited

U.S. PATENT DOCUMENTS

| | | | | |
|---|---|---|---|---|
| 4,253,399 | A | 3/1981 | Spigarelli | |
| 4,344,364 | A | 8/1982 | Nickles et al. | |
| 5,630,565 | A | 5/1997 | Lumbis | |
| 6,691,957 | B2 | 2/2004 | Hess, Jr. et al. | |
| 2002/0036252 | A1 | 3/2002 | Braband | |
| 2003/0034423 | A1 | 2/2003 | Hess, Jr. et al. | |
| 2006/0138285 | A1 * | 6/2006 | Oleski et al. | 246/167 R |

OTHER PUBLICATIONS

International Search Report and Written Opinion, issued in PCT/US2009/050650, dated Mar. 24, 2010.

* cited by examiner

*Primary Examiner* — Mark Le
(74) *Attorney, Agent, or Firm* — DLA Piper LLP US

(57) ABSTRACT

A fuel efficiency improvement device for use on each of a plurality of locomotives in a consist includes a processor configured to transmit an initialization message including an identifier and power and fuel consumption rate information for the locomotive on which it is installed to all other locomotives in the consist. One of the devices is chosen to act as a lead device. The lead device is responsible for determining alternative throttle notch settings for each of the locomotives based on the power and fuel consumption rate information in the initialization message. The lead device may be chosen on the basis of identifiers in the initialization messages such as serial numbers. The alternative throttle settings may be determined using greedy value and maximum power calculations.

20 Claims, 6 Drawing Sheets

FUEL EFFICIENCY IMPROVEMENT FOR LOCOMOTIVE CONSISTS

BACKGROUND

1. Field

The present invention relates generally to the railroad field and more particularly to devices, systems and methods for improving fuel efficiency in locomotive consists.

2. Discussion of the Background

A locomotive consist is a group of locomotives physically coupled together and configured to act as a single unit from the controls of a single locomotive in the consist. In the U.S., the operation of multiple locomotives in this manner is often referred to as multiple unit, or "MU", operation. In this mode, the throttle setting (also referred to as the throttle notch) in the lead locomotive, which may not be the first locomotive in the consist, controls the throttle setting or notch in all locomotives in the consist. A locomotive throttle typically has eight notches and an idle position. Thus, for example, if an operator in a lead locomotive in an MU consist puts the throttle into notch 5, then every other locomotive in the consist will also operate at a notch 5 throttle setting (it should be understood that the actual throttle may or may not move, but that the control signals supplied to the locomotive power plant will correspond to a notch 5 throttle setting).

It has been recognized that the operation of all locomotives in a consist in the same throttle setting is not always fuel efficient. Many locomotives are more efficient at higher notch settings. Thus, it may be more fuel efficient for some of the locomotives in a consist to operate at a higher notch setting than that set by the operator while others in the consist operate at a lower setting. For example, in a three locomotive consist, it may be more fuel efficient for two of the locomotives to operate in notch 8 with the third in neutral rather than all three locomotives operating in notch 5, assuming that the total power is approximately the same.

Others have devised systems and methods for improving fuel efficiency. Such systems include U.S. Pat. Nos. 4,344,364 and 6,691,957. Such systems are less than optimal.

DETAILED DESCRIPTION

In the following detailed description, a plurality of specific details, such as specific signals used for multiple locomotive control in a consist and exemplary fuel burn rates and efficiency calculations, are set forth in order to provide a thorough understanding of the preferred embodiments discussed below. The details discussed in connection with the preferred embodiments should not be understood to limit the present invention. Furthermore, for ease of understanding, certain method steps are delineated as separate steps; however, these steps should not be construed as necessarily distinct nor order dependent in their performance.

Figure 1:
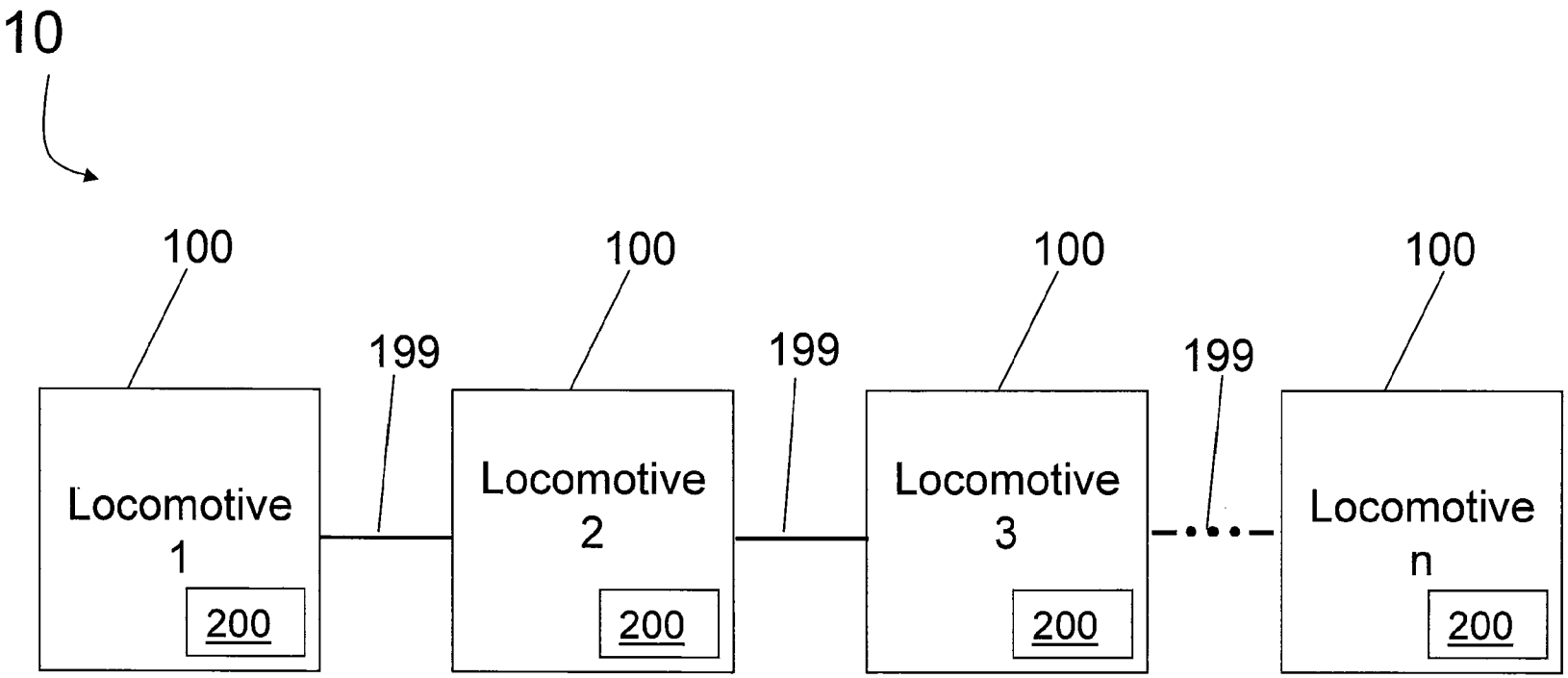
FIG. 1 is block diagram of a locomotive consist.

FIG. 1 is a block diagram of a locomotive consist 10. The consist 10 includes a plurality of locomotives 100, each of which is provided with a fuel efficiency improvement (FEI) device 200. Each of the locomotives 100 is coupled to one or two neighboring locomotive by MU jumpers 199. At the present time, the standard MU jumper includes 27 conductors. Preferred embodiments of the invention make use of conductors included on standard MU jumpers 199 for communications between FEI devices 200 on different locomotives 100. In alternative embodiments, additional conductors (which may be included in the MU jumpers 199 or may be provided via physically separate cables) may be added for such inter-locomotive communications, or wireless communications may be used instead. It should further be recognized that additional cars (e.g., freight cars) may also be present in consists and that such non-locomotive vehicles may be interposed between locomotives in the consists (such consists are sometimes referred to as distributed power consists).

Although each locomotive 100 includes an FEI device 200 in the consist 10 of FIG. 1, it should be understood that it is possible for some of the locomotives 100 not to be equipped with an FEI device in some embodiments. In such embodiments, the engine control signals on those locomotives not equipped with an FEI device 200 may be electrically connected to the signals on the MU jumper corresponding to the throttle position set on the lead locomotive in the conventional manner. In other words, if a locomotive 100 in the consist 10 does not have an installed FEI device 200, that locomotive will be controlled in accordance with the notch selected by the operator in the lead locomotive.

Figure 2:
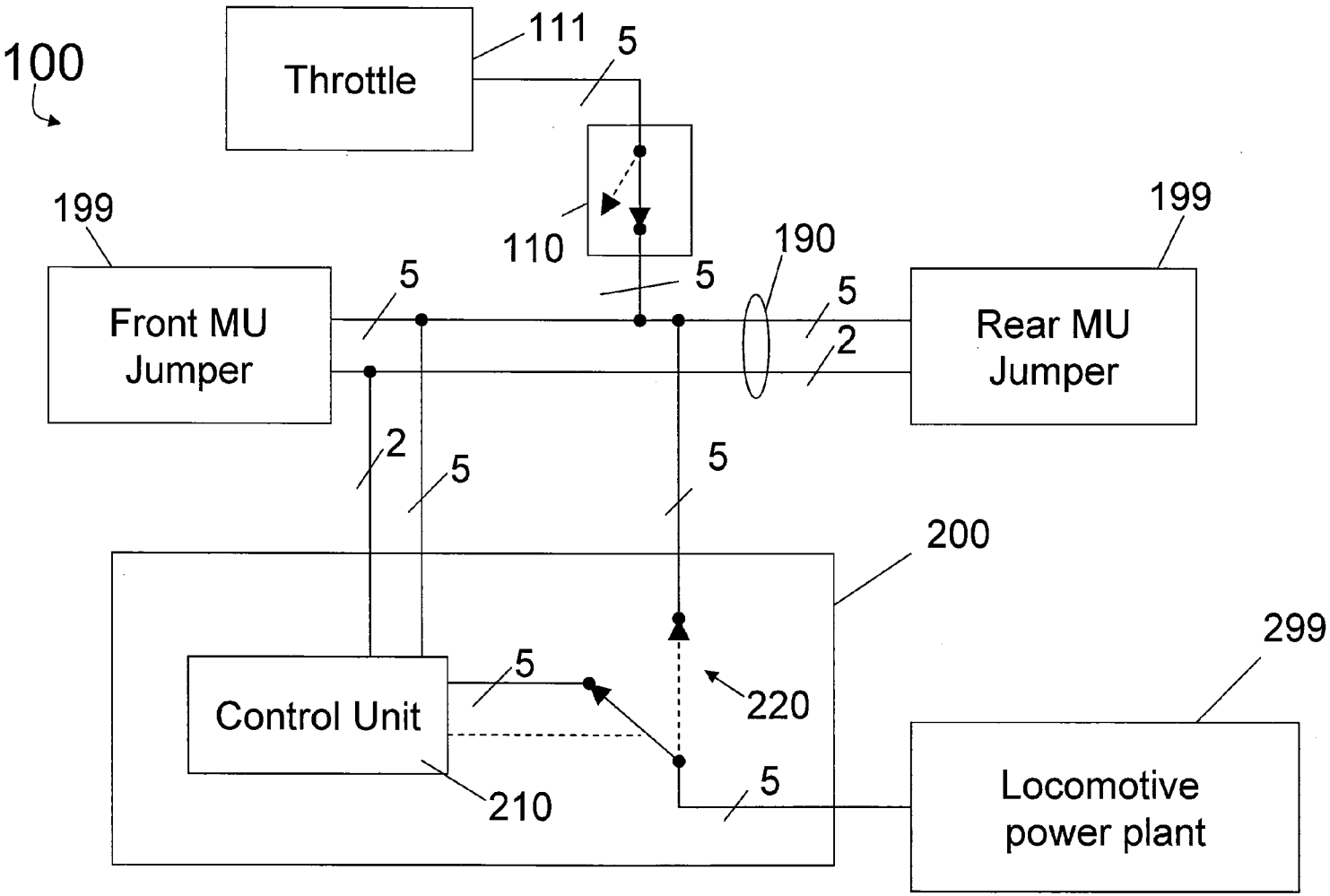
FIG. 2 is a schematic diagram illustrating the connection of a fuel efficiency improvement device according to an embodiment.

FIG. 2 is schematic diagram illustrating the FEI device 200 and its interconnection to the locomotive power plant 299 and devices in other locomotives in greater detail. As shown in FIG. 2, the FEI device 200 includes a control unit 210. The control unit 210 will be shown in greater detail in FIG. 3 discussed below. The control unit 210 outputs a signal that controls an electrically controlled single pole double throw switch 220, which is also a part of the FEI device 200. The electrically controlled switch may be implemented with relays, solenoids, high power transistors, or any other type of electrically controlled switch. The common terminal (actually five terminals) of the electrically controlled switch 200 is connected to the locomotive power plant 299 by five conductors. These five conductors carry signals that control the generator field and the A, B, C, and D governors on the locomotive (these governors are typical of the control system commonly found on diesel electric locomotives in North America). Together, these five signals control how much power is output by the locomotive power plant 299. The five signals are 74 volt DC signals that may either be on (+74V DC) or off (0V). Table 1 below lists the signals for the various throttle notch settings in a typical North American locomotive:

TABLE 1

| Throttle Notch | Generator Field | A | B | C | D |
|---|---|---|---|---|---|
| Low Idle | 1 | 0 | 0 | 0 | 1 |
| 1 | 0 | 0 | 0 | 0 | 0 |

TABLE 1-continued

| Throttle Notch | Generator Field | A | B | C | D |
|---|---|---|---|---|---|
| 2 | 0 | 1 | 0 | 0 | 0 |
| 3 | 0 | 0 | 0 | 1 | 0 |
| 4 | 0 | 1 | 0 | 1 | 0 |
| 5 | 0 | 0 | 1 | 1 | 1 |
| 6 | 0 | 1 | 1 | 1 | 0 |
| 7 | 0 | 0 | 1 | 1 | 0 |
| 8 | 0 | 1 | 1 | 1 | 0 |

(1 = +74 VDC; 0 = 0 VDC)

The input terminal on the right side of the switch 220 is connected to receive the five locomotive control signals discussed above from the trainline 190 to which both the front and rear MU jumpers 199 and possibly the throttle 111 (depending on the position of switch 110) are connected. Thus, when the switch 220 is in the right position, the locomotive power plant 299 is not under control of the FEI device 200. The left input terminal of the switch 220 is connected to receive the five locomotive control signals generated by the control unit 210 (the method by which these signals are generated will be discussed in further detail below). Thus, when the switch 220 is in the left position, the locomotive power plant 299 is under the control of the FEI device 200.

The control unit 210 is also connected to the five conductors of the trainline 190 (the trainline refers to a 27 conductor path formed by the conductors on individual locomotives as well as any MU jumpers that are connected to the rear and front MU jumper receptacles on a locomotive and any other locomotives connected via such MU jumpers) that carry the generator field and A-D governor signals and the two conductors of the trainline 190 and carry the forward and reverse signals. The five conductor connection to the generator field and A-D governors allows the control unit 210 to determine which throttle notch the train operator has selected. The two conductor connection to the forward and reverse signals are used by the control unit 210 to communicate with control units 210 on other locomotives 100 in the consist 10 via the trainline 190. The conductors carrying the forward and reverse signals are used in some embodiments because these signals are generally "quiet" signals, meaning that they are switched infrequently (indeed, if a train does not reverse direction during a run, no switching is necessary once the run has begun). The types of inter-locomotive communications will be discussed in further detail below in connection with FIG. 3. As discussed above, other conductors on the trainline 190 are used for such inter-locomotive communications in some other embodiments, and wireless or optical communications between locomotives is used in yet other embodiments.

As shown in FIG. 2, the throttle 111 is connected to the trainline 190 via a single pole, single throw switch 110. In practice, this switch 110 is typically a manually operated rotary switch. The switch 110 isolates the throttle 111 from the trainline 190 when in the open position (as would be the case on a trailing locomotive 100 in the consist 10) and connects the throttle 111 to the trainline 190 when in the closed position (as would be the case on the lead locomotive 100 in the consist 10). Those of skill in the art will recognize that other types of switching are also possible.

Figure 3:
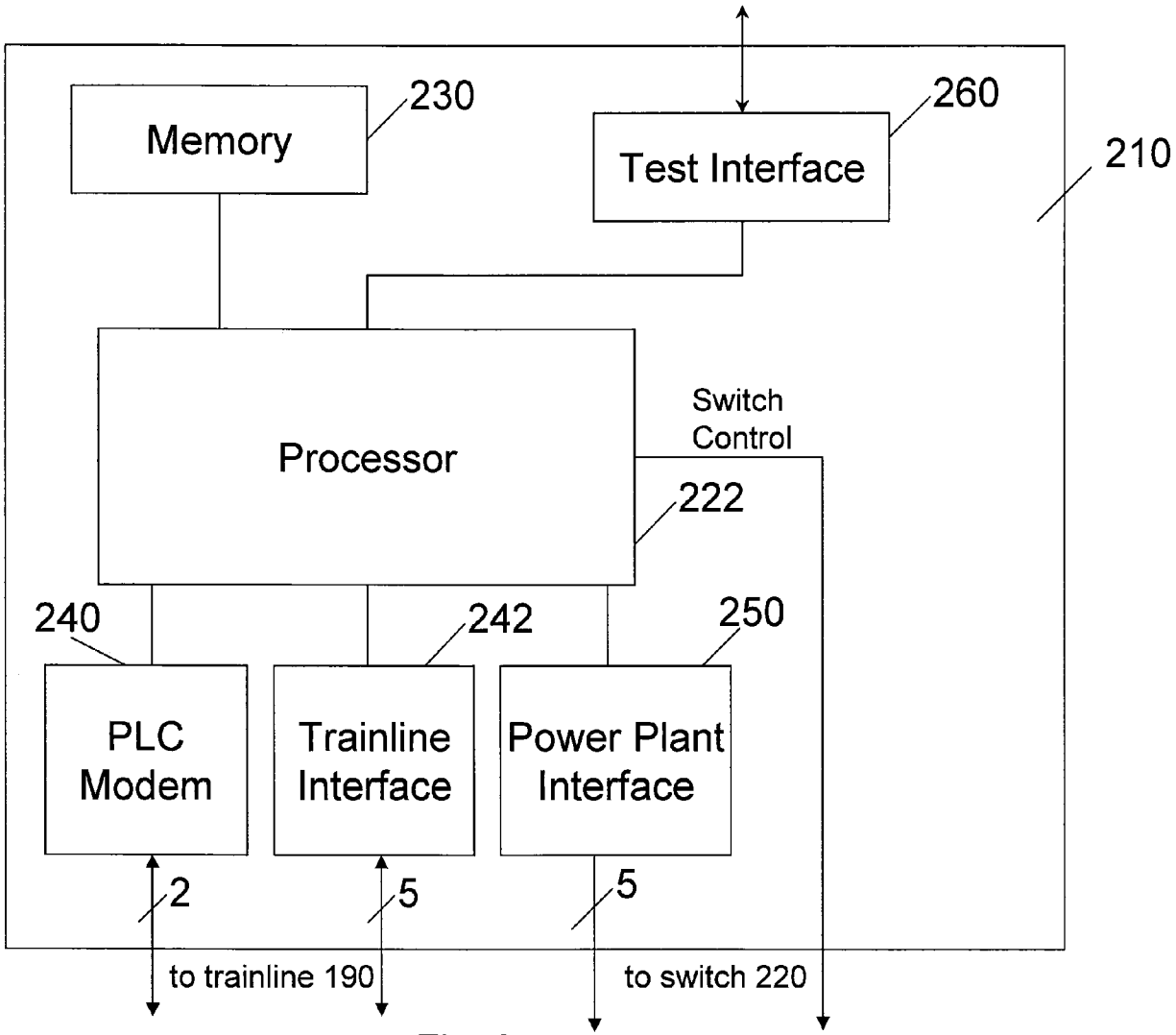
FIG. 3 is a block diagram of a control unit of the fuel efficiency improvement device of FIG. 2 according to an embodiment.

The control unit 210 is illustrated in greater detail in FIG. 3. The control unit 210 is controlled by a processor 222. The processor 222 is a microprocessor, but may be a microcontroller, a digital signal processor, a reduced instruction set processor, a discrete logic circuit, or any other circuit capable of exercising a control function in other embodiments. The processor 222 is connected to a memory 230, which may include both non-volatile (e.g., ROM or flash memory) for program storage and volatile (e.g., RAM) for program execution as is well known in the art. The processor 222 is also connected to the forward and reverse conductors of the trainline 190 via a first PLC (power line communication) modem 240 and to the generator field and A-D governor conductors of the trainline 190 via a trainline interface 242. The processor 222 is also connected to a power plant interface 250 for outputting the five locomotive power plant control signals (generator field and A-D governors). The interface 250 accepts digital signals at a level output by the processor 220 and converts these signals to 74 volt DC signals using, e.g., relays or high power transistors (those of skill in the art will recognize that such a circuit can be implemented in any number of other ways). The processor 222 also outputs a switch control signal that is connected to control the position of the switch 220 of FIG. 2. Finally, the processor 222 is connected via a test interface 260, which comprises a JTAG test port in some embodiments. The test interface 260 will not be discussed in further detail herein to avoid obscuring the present invention.

Figure 4:
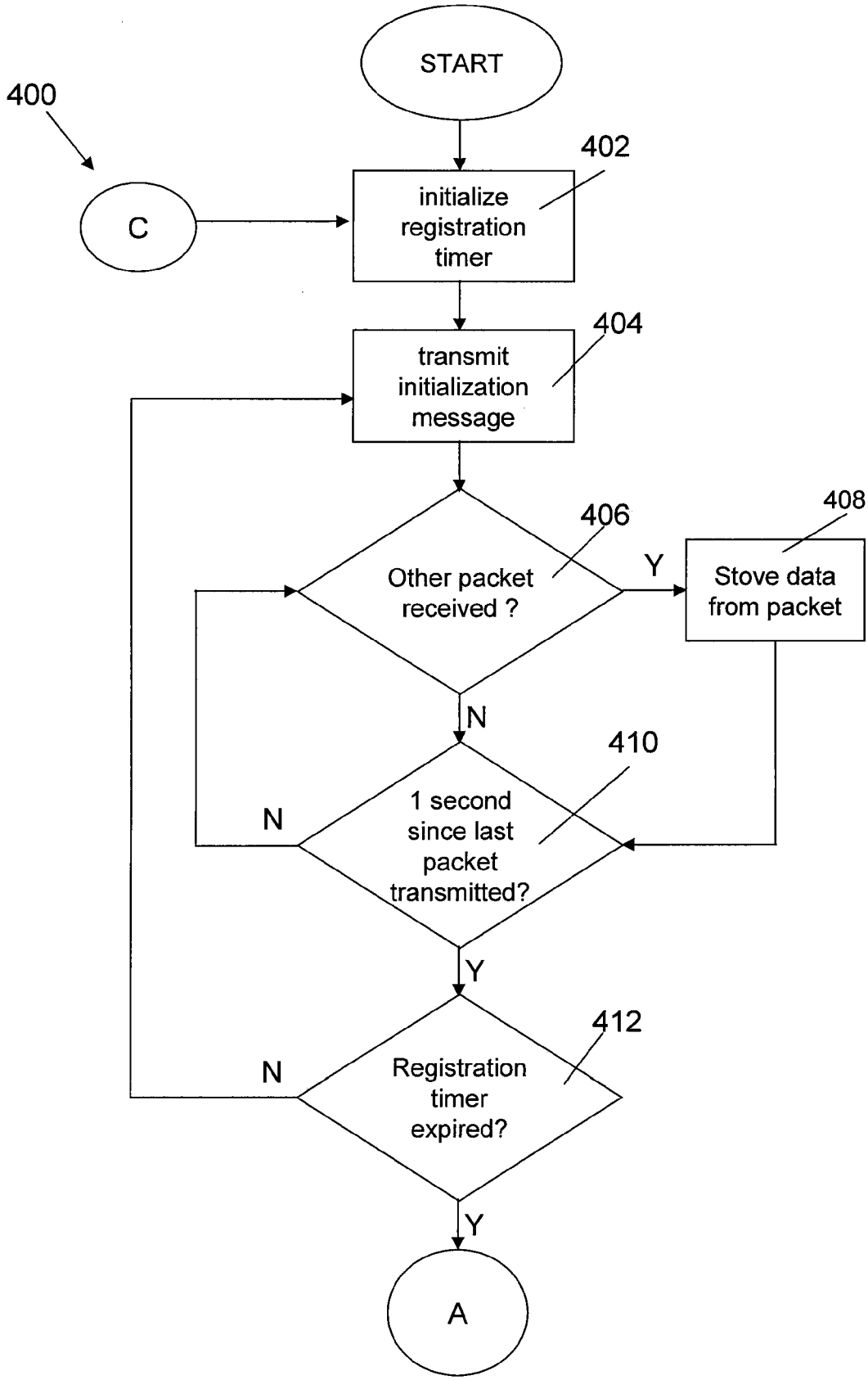
FIG. 4 is a flowchart illustrating operations performed by the control unit of the fuel efficiency improvement device of FIG. 3 according to an embodiment.

The processing performed by processor 222 will now be discussed in connection with the flowchart 400 of FIG. 4. The processor 222 first initializes a registration timer at step 402. The registration timer is set to a time period such as ten seconds. Next, the processor transmits an initialization message at step 404 over the forward and rear conductors of the trainline 190 via the PLC Modem 240. In some embodiments, the processor 222 calculates a back-off (or exponential back-off) period using the FEI Device's serial number, and transmission of the initialization message is delayed by the back off period in order to reduce collisions between initialization messages from different FEI devices 200 in the consist 10 in a manner well known to those of skill in the art (those of skill in the art will recognize that this refers to a carrier sense multiple access/collision detect communication scheme, and that other types of communication schemes may be used in other embodiments).

The contents of the initialization message are shown in Table 2 below:

TABLE 2

(Initialization Message Contents)

| Description | Number of Bytes |
|---|---|
| Data Valid | 1 |
| Internal Status Data | 4 |
| Current Notch | 1 |
| FEI Device Address | 1 |
| FEI Device Serial Number | 4 |
| Idle Fuel Consumption Rate (GPH) | 2 |
| Idle Power (HP) | 2 |
| Notch 1 Fuel Consumption Rate (GPH) | 2 |
| Notch 1 Power (HP) | 2 |
| Notch 2 Fuel Consumption Rate (GPH) | 2 |
| Notch 2 (HP) | 2 |
| Notch 3 Fuel Consumption Rate (GPH) | 2 |
| Notch 3 (HP) | 2 |
| Notch 4 Fuel Consumption Rate (GPH) | 2 |
| Notch 4 (HP) | 2 |
| Notch 5 Fuel Consumption Rate (GPH) | 2 |
| Notch 5 (HP) | 2 |
| Notch 6 Fuel Consumption Rate (GPH) | 2 |
| Notch 6 (HP) | 2 |
| Notch 7 Fuel Consumption Rate (GPH) | 2 |

TABLE 2-continued (Initialization Message Contents)

| Description | Number of Bytes |
|---|---|
| Notch 7 (HP) | 2 |
| Notch 8 Fuel Consumption Rate (GPH) | 2 |
| Notch 8 (HP) | 2 |

In Table 2 above, Data Valid refers to a pattern that indicates the start of a message. Internal Status Data is a field of four bytes that includes status information useful for troubleshooting; the specific contents of this field are application specific and unrelated to the inventive concepts discussed herein. Current Notch refers to the notch information read by the processor 222 via the trainline interface 242 from the trainline 190. Transmitting this information by all of the FEI devices 200 in the initialization message allows the processor 222 in the lead locomotive FEI device to detect a malfunction in any FEI device 200 in reading the throttle settings on any of the locomotives 100 in the consist 10. FEI Device Address refers to a one byte address that is used for all communications between FEI devices 200 in the consist. The FEI Address rather than the serial number is used to identify particular FEI devices 200 in the consist in order to save bandwidth by reducing the size of the initialization messages as the former is one byte long and the latter is four bytes long. The FEI Device Address is assigned by a pseudo-random number generator in some embodiments and may be stored in a non-volatile memory for use in multiple sessions or may be generated anew each time the FEI Device 200 is powered on. Because this is a one byte field with only 256 possible values and because the FEI Device Address is assigned randomly, there is some chance that two different FEI devices 200 in a single consist will generate the same FEI Device Address. In such a situation, the FEI device 200 that acts as the lead will transmit a change address message to the address; the change address message will also include the FEI Device Serial Number so that each of the FEI devices 200 sharing the same FEI Address will receive the message but only the FEI device 200 with a serial number that matches the serial number in the message will act on the message by changing its FEI Device Address. FEI Device Serial Number is a unique number that is assigned to each FEI device 200 at the time of manufacture. The remainder of Table 2 is a listing of the fuel consumption (in gallons per hour) and power (in horsepower) for each position of the throttle 111. It should be noted that it is not necessary for the power and fuel consumption rates for the idle throttle position to be transmitted. In some embodiments, only the power and fuel consumption rates for the power throttle settings (i.e., the throttle settings which result in the application of tractive effort by the locomotive) are included in the initialization messages.

The transmission of power and fuel consumption rate for each notch setting rather than a model number significantly reduces configuration management because it does not require existing installed FEI devices to be updated as new locomotives are added to an operator's fleet as would be the case in a system in which only the locomotive model number were transmitted. Consider, for example, a fleet of locomotives of three different types. It would be possible for a system to operate in a manner in which a model number or other code was transmitted in the initialization message to identify the type of locomotive. Fuel consumption and power information could be retrieved from a database using the model number or other identifier in the initialization message as an index, and this information used for performing the fuel efficiency calculations performed by the lead locomotive as discussed in further detail below. Such an arrangement would be beneficial in that it would reduce the amount of information necessary for the initialization message. However, if a new type of locomotive were to be added to the fleet, it would require each database on each locomotive to be updated with fuel consumption and power data for the new locomotives so that any fuel efficiency improvement device that acted as the master would have the necessary data to perform fuel performance calculations. In contrast, by having each locomotive transmit the fuel consumption and power information in the initialization packet, the information for each locomotive in the consist can be saved by whichever locomotive acts as the lead such that no database update is necessary even when new locomotive types are added to a fleet. This feature will even allow locomotives from different fleets to operate together, provided that each is equipped with the same type of FEI device 200.

After transmission of the initialization message at step 404, the processor 202 determines if initialization messages from other locomotives has been received via the PLC modem 240 at step 406. If such a message has been received at step 406, the data from the initialization message is stored at step 408. Then, or if no message from another FEI has been received at step 406, the processor determines if a one second timeout period since the processor 222 transmitted its initialization message at step 404 has expired at step 410. If the one second period has not expired, step 406 is repeated. If the one second period has expired at step 410, the processor 222 determines whether the registration timer has expired at step 412. If the registration period has not expired, step 404 is repeated. If the registration timer has expired at step 412, then the registration period has expired and the processing continues as discussed below.

Figure 5:
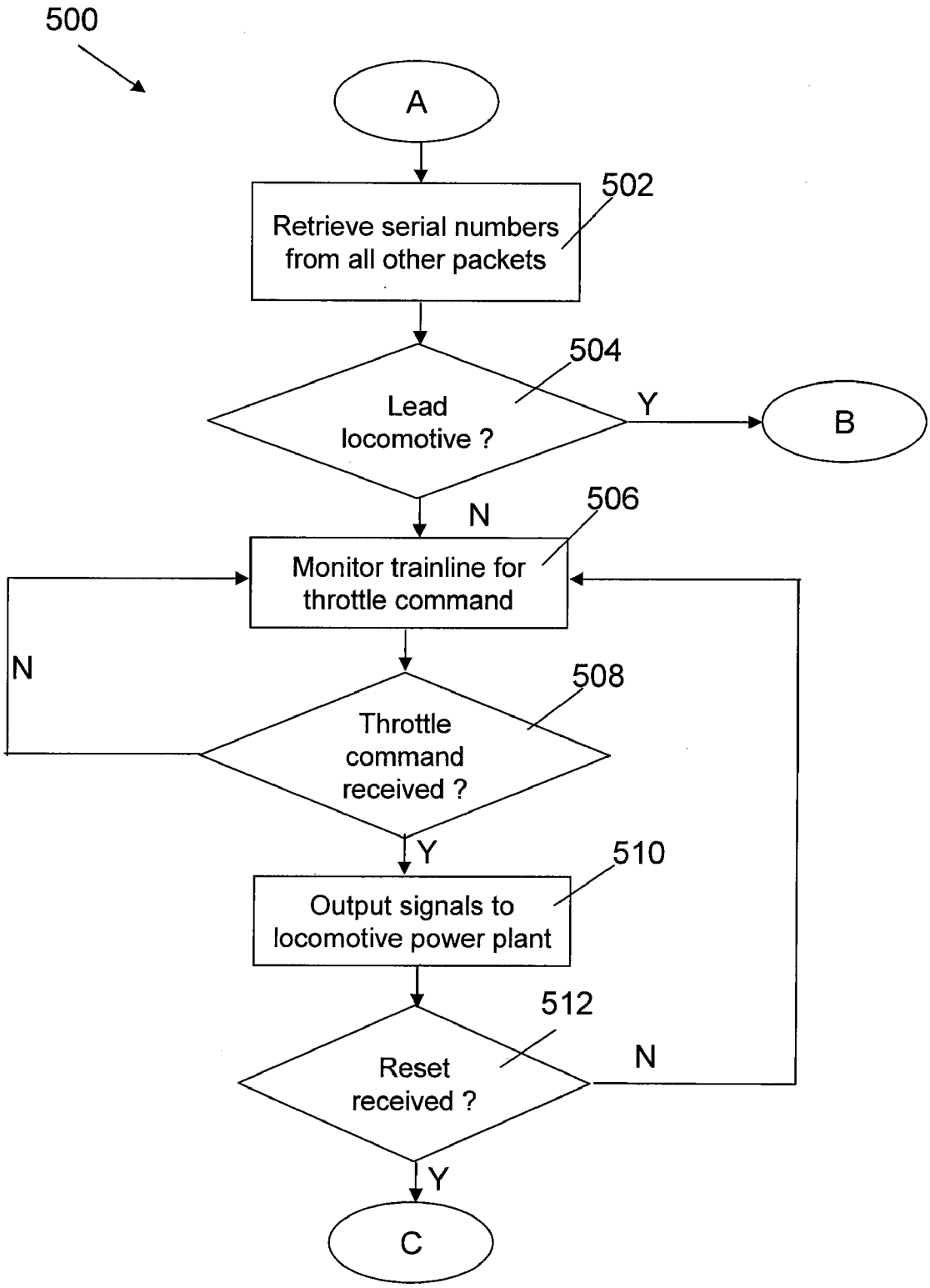
FIG. 5 is a flowchart illustrating additional operations performed by the control unit of the fuel efficiency improvement device of FIG. 3 according to an embodiment.

FIG. 5 is a flowchart 500 illustrating the processing performed by the processor 200 at the end of the registration period. The processor 222 retrieves its serial number and the serial numbers from the initialization messages from all other FEI devices 200 received during the registration period at step 502. Based on these serial numbers, the processor determines whether it is the lead locomotive at step 504. In some embodiments, the FEI device 200 with the highest serial number acts as the lead locomotive; in other embodiments, the processor with the lowest serial number acts as the lead locomotive. It should be understood that any other identifier (e.g., the FEI Device Address) in the initialization message could be used for determining the lead locomotive. If the processor 222 determines that it is not the lead device at step 504, the processor 222 enters a loop in which it monitors the trainline 190 for changes in the throttle command from the lead FEI device at step 508. If no new command is received at step 508, step 506 is repeated. If a new command is received at step 508, the processor 222 outputs signals corresponding to the notch setting in the command to the locomotive power plant 299 via the interface 250 at step 510. The processor 222 then determines whether a reset indication is present in the new command message at step 512. If no reset command has been received at step 512, step 506 is repeated. If a reset command is received at step 512, step 402 is repeated. Providing for a reset command allows the processor 222 to automatically declare a reset and, in some embodiments, allows an operator to reset the system manually by depressing a reset switch connected to an input port (not shown in FIG. 3) connected to the processor 222.

Figure 6:
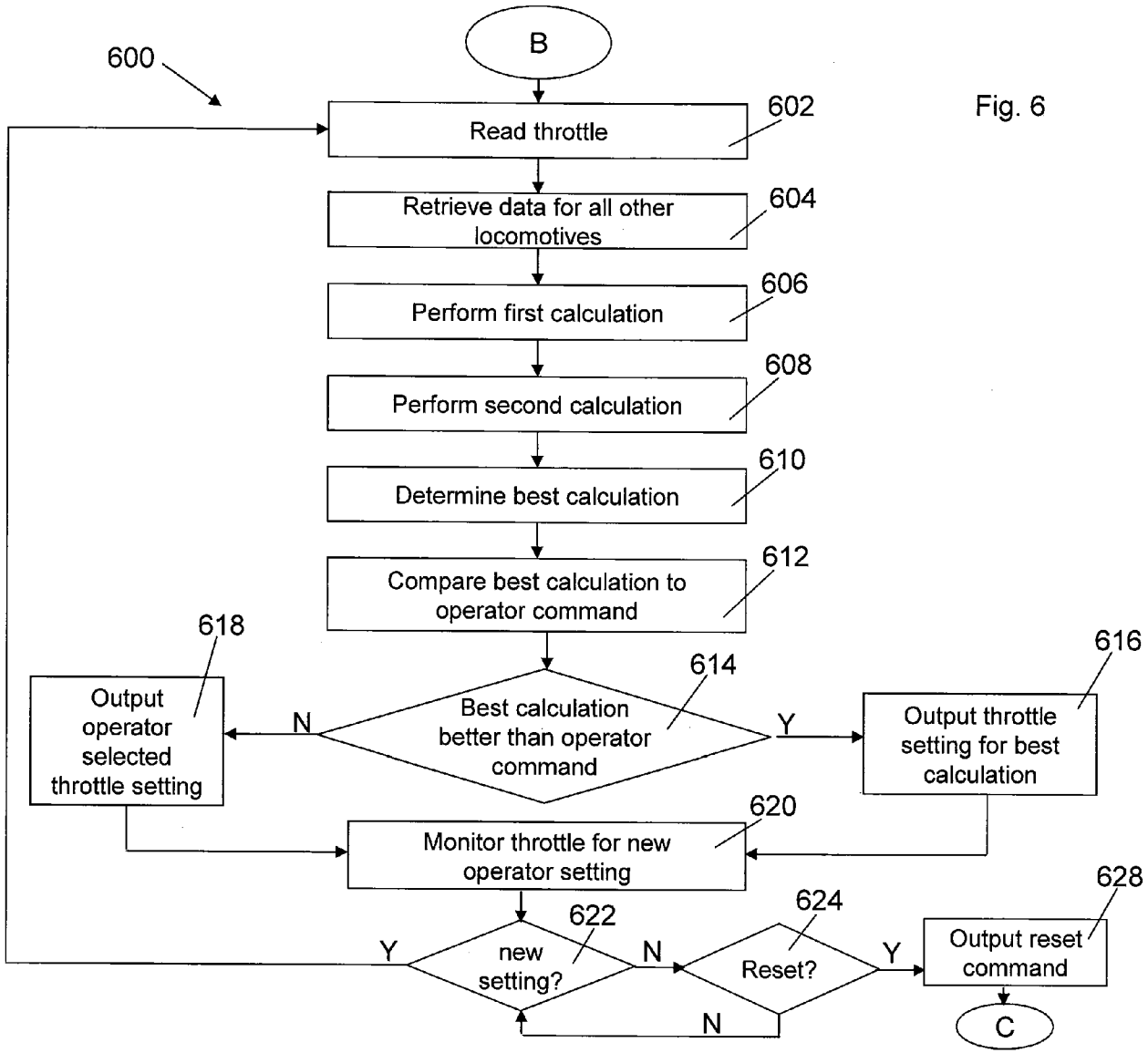
FIG. 6 is a flowchart illustrating additional operations performed by the control unit of the fuel efficiency improvement device of FIG. 3 according to an embodiment.

If the processor 222 determines that it is the lead FEI device, then the processing illustrated in the flowchart 600 of FIG. 6 is performed. It should be noted that the lead FEI device may not be located on the "lead" locomotive (i.e., the locomotive on which the operator is located and from which the operator manually controls the throttle). The processor begins by reading the throttle position from the trainline 190 at step 602 (this assumes that the switches 110 on each of the locomotives has been properly set so that one locomotive (the locomotive in which the operator is located) is the lead locomotive and has its throttle connected to the trainline 190, while the switch 110 on every other locomotive in the consist is set such that the throttle 111 on that locomotive is isolated from the trainline 190). The processor 222 then retrieves the fuel consumption and power information corresponding to the various throttle notch settings for the locomotive on which it is installed and the fuel consumption and power information corresponding to the various throttle notch settings for the other locomotives received in initialization messages during the initialization stage discussed earlier in connection with FIG. 4.

The fuel consumption and power information retrieved at step 604 is used by the processor 222 to perform a first fuel efficiency calculation at step 606 in order to determine alternative, more fuel efficient throttle notch settings for the locomotives in the consist. In some embodiments, the first calculation is a "greedy value" calculation. In this calculation, a greedy value equal to a ratio of power to fuel consumption rate is calculated for each notch setting for each locomotive in the consist. Then, the total desired consist power corresponding to the throttle notch setting selected by the operator is determined (the total desired consist power is the power that would result if each locomotive in the consist were set to the throttle notch selected by the operator). The processor 222 then selects the locomotive with the highest greedy value corresponding to a power not exceeding the total desired consist power (plus a threshold percentage), sets the locomotive throttle to the notch corresponding to the lowest greedy value corresponding to the power not exceeding the total desired consist power (plus a threshold percentage), and subtracts that power corresponding to the throttle notch set in the preceding step from the total desired consist power and replaces the previous value of the total desired consist power with this new value. The processor 222 then selects the locomotive with the lowest remaining greedy value that corresponds to a power that does not exceed the revised total desired consist power (plus or minus a threshold percentage) and repeats the steps discussed above.

This process continues until alternative notch settings for some number of locomotives that correspond to a total power equal to the total desired power plus or minus a threshold percentage have been determined. If the total desired consist power has been reached before the notch settings for all locomotives in the consist have been determined in the manner described above, then the alternative notch settings for the remaining locomotives are set to idle. If it is not possible to assign notch settings such that the total desired consist power is achieved within plus or minus the threshold percentage, the algorithm fails and the processor 222 ignores the results of the "greedy value" calculation. In some embodiments, the threshold percentage is 5%.

A second fuel efficiency calculation is performed at step 608 using the fuel consumption and power information retrieved at step 604. In some embodiments, the second calculation is a "maximum power" calculation. This calculation operates under the assumption that the throttle notch setting for the highest power on a locomotive will also be the most fuel efficient, which as a practical matter is often true. In this calculation, the total desired consist power is calculated in the manner discussed above. Next, the locomotive with the highest possible power less than or equal to the total desired consist power (plus or minus the threshold percentage) is identified and the throttle for that locomotive is assigned to the corresponding notch. The power associated with the corresponding notch is then subtracted from the total desired consist power. This process is then repeated for the next remaining locomotive with the highest possible power less than or equal to the total desired consist power (plus or minus the threshold percentage). When a point is reached at which the highest power for all remaining locomotives (i.e., locomotives for which no throttle setting has been assigned by the maximum power algorithm) exceeds the remaining total desired consist power (plus or minus the threshold percentage), the locomotive with a notch setting having a corresponding power that is the highest without exceeding the remaining total desired consist power (plus or minus the threshold percentage) is selected, and assigned with that throttle notch setting. The process continues in this fashion until the remaining total desired consist power (plus or minus the threshold percentage) has been reached by the throttle settings assigned by the algorithm. The fuel consumption rate for the assigned throttle settings is then calculated. If it is not possible to assign alternative notch settings such that the total desired consist power is achieved within plus or minus the threshold percentage, the algorithm fails and the processor 222 ignores the results of the "maximum power" calculation.

Those of skill in the art will recognize that the greedy value and maximum power calculations described above are but two of many different calculations that could be performed. In other embodiments, a brute force approach is taken in which the fuel consumption and power values for every possible combination of notch settings on every locomotive are calculated, and the combination with the lowest fuel consumption rate and the power that is within the total desired consist power (plus or minus the threshold percentage) is selected. This algorithm is relatively straightforward to apply and may yield better fuel efficiency than that achieved by the algorithms discussed above, but can involve significant processor and memory resources when the number of locomotives in the consist is large.

The results of the first and second calculations from steps 606 and 608 are compared and the best result determined at step 610. The total consist fuel consumption rate using the alternative notch settings for one result is compared to the total consist fuel consumption rate for the notch settings from the other result. The fuel consumption rate for the best result is compared to the fuel consumption rate for the operator selected throttle notch setting at step 612. If the fuel consumption rate for the calculated throttle notch settings is better than the fuel consumption rate corresponding to the operator entered throttle notch setting, the processor 222 outputs the calculated throttle notch setting at step 616. This step 616 includes outputting a switch control signal such that the switch 220 of FIG. 2 is placed in the left position and outputting the calculated throttle notch setting for the lead FEI device 200 via the interface 250, as well as outputting to each of the other FEI devices 200 in the consist a message with the desired throttle notch setting for the respective locomotive on which it is installed via the PLC modem 240. If the fuel consumption rate for the calculated throttle notch settings is not better than the fuel consumption rate corresponding to the operator entered throttle notch setting at step 614, the operator selected throttle notch setting is output at step 618. This step includes both setting the switch 220 on the locomotive on which the lead FEI device is installed to the right position (or outputting the operator-selected throttle notch setting for the locomotive on which the lead FEI device 220 is installed via the interface 250) and outputting to each of the other FEI devices in the consist a message with the operator-selected throttle notch setting for that locomotive via the PLC modem 240.

Next, the processor 222 monitors the generator field and A-D governor signals on the trainline 190 to detect any change in the throttle notch setting by the operator at step 622. If a change is detected, step 602 is repeated. If no change is detected, the processor 222 determines whether the reset switch has been set at step 624 and, if so, outputs a reset command at step 628 and repeats step 402. If the reset button has not been pressed at step 624, step 622 is repeated.

Those of skill in the art will recognize that many changes to the embodiments discussed above are possible. For example, it is possible for the FEI device to operate with only a single fuel efficiency calculation (e.g., the brute force calculation discussed above). Also, rather than having one single FEI device act as a lead FEI device and send throttle commands to the other FEI devices, it is possible for each FEI device to perform a calculation (preferably the same calculation as all other FEI devices in the consist) and control the locomotive based on that calculation. Still other variations will be readily apparent to those of skill in the art.

It should be mentioned that some embodiments include a quiet cab option. Because the noise level in a locomotive can be very high when the throttle notch is in a high power setting, and even has the potential to damage an operator's hearing on some locomotives, it is sometimes desirable to operate the locomotive in which the operator is located at an idle throttle setting to reduce noise. In such embodiments, the FEI device 200 on the locomotive in which the operator is located transmits a "quiet cab" indication in its initialization message (or in a subsequent message), which may be triggered by the detection of a quiet cab button push by the operator. When the lead FEI device detects a quiet cab indication, the lead FEI device "ignores" (i.e., does not take the greedy value ratios or maximum power/fuel consumption rate information) when it calculates alternative throttle notch settings for the consist and instead assigns the locomotive from which the quiet cab indication was initiated an idle alternative notch setting.

While the invention has been described above with respect to certain specific embodiments, it will be appreciated that many modifications and changes may be made by those skilled in the art without departing from the spirit of the invention. It is intended by the appended claims to cover all such modifications and changes as fall within the true spirit and scope of the invention.

Furthermore, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is not intended to be limiting as to the scope of the present invention in any way.

What is claimed is:

1. A method for controlling locomotive power plants on a plurality of locomotives in a consist comprising the steps of:

transmitting, from a fuel efficiency improvement device located on each locomotive in the consist, an initialization message including an identifier of the fuel efficiency improvement device, and a power level and fuel consumption rate corresponding to each power throttle setting for a respective locomotive;

determining a fuel efficiency improvement device to act as a lead fuel efficiency improvement device for all fuel efficiency improvement devices in the consist based on the serial numbers of the fuel efficiency devices in the consist;

determining by the lead fuel efficiency improvement device an operator throttle setting selected by an operator on a locomotive in the consist;

determining an operator consist power, the operator consist power being a total combined power that would result if the locomotive power plant for each locomotive in the consist were operated in accordance with the operator throttle setting;

determining by the lead fuel efficiency device alternative throttle settings for each of the locomotives in the consist using power levels and fuel consumption rates from the initialization messages, the alternative throttle settings resulting in an alternative total consist power within a threshold amount of the operator consist power and an alternative fuel consumption rate lower than a fuel consumption rate that would result if the locomotive power plant for each locomotive in the consist were operated in accordance with the operator throttle setting;

transmitting the alternative throttle notch settings from the lead fuel efficiency improvement device to respective fuel efficiency devices in the consist; and applying an alternative notch setting to a respective locomotive power plant by each of the fuel efficiency improvement devices in the consist.

2. The method of claim 1, wherein the lead fuel efficiency improvement device is the fuel efficiency device in the consist with the lowest serial number.

3. The method of claim 1, wherein the serial number of each fuel efficiency improvement device is included in a respective initialization message transmitted by that fuel efficiency improvement device.

4. The method of claim 1, wherein the initialization messages are transmitted between locomotives in the consist on conductors defined in a standard twenty seven pin multiple unit jumper.

5. The method of claim 4, wherein the conductors correspond to the forward and reverse signals.

6. The method of claim 1, wherein the step of determining alternative throttle settings for each of the locomotives in the consist comprises the steps of:

calculating, for each notch setting of each locomotive, using information from the initialization message received from a respective locomotive, a greedy value ratio, the greedy value ratio being a ratio of power to fuel consumption rate;

identifying a highest greedy value ratio corresponding to a power not exceeding the operator consist power by more than a threshold amount from among all greedy ratio values for all locomotives that have not been assigned an alternative notch setting;

assigning an alternative notch setting corresponding to the highest greedy value identified in the previous step to the locomotive associated with the highest greedy value identified in the previous step;

repeating the calculating, identifying and assigning steps until a total power associated with each of the alternative notch settings assigned in the assigning steps is within the threshold amount of the operator consist power; and assigning an idle notch setting to any locomotive in the consist that was not assigned an alternative notch setting associated with a highest greedy value identified in an iteration of an identifying step.

7. The method of claim 1, wherein the step of determining alternative throttle settings for each of the locomotives in the consist comprises the steps of:

identifying a locomotive having a highest possible output power not exceeding the operator consist power by more than a threshold amount from among all locomotives that have not been assigned an alternative notch setting;

assigning an alternative notch setting to the locomotive identified in the identifying step, the alternative notch setting being associated with the highest possible output power not exceeding the operator consist power by more than the threshold amount;

repeating the identifying and assigning steps until a total power associated with each of the alternative notch settings assigned in the assigning steps is within the threshold amount of the operator consist power; and assigning an idle notch setting to any locomotive in the consist that was not assigned an alternative notch setting associated with a highest possible output power not exceeding the operator consist power identified in an iteration of an identifying step.

8. A fuel efficiency improvement device located on a locomotive in a locomotive consist for controlling a locomotive power plant, the fuel efficiency improvement device comprising:

a processor;

a memory connected to the processor;

a transceiver connected to the processor, the transceiver being configured for communication with other fuel efficiency improvement devices; and a trainline interface connected to the processor; and a power plant interface connected to apply a throttle notch signal to the locomotive power plant;

wherein the processor is configured to perform the steps of:

transmitting an initialization message including an identifier of the fuel efficiency improvement device, and a power level and fuel consumption rate corresponding to each power throttle setting for the locomotive;

determining whether the fuel efficiency improvement device is the lead fuel efficiency improvement device for other fuel efficiency improvement devices in the consist based on the serial numbers of the fuel efficiency devices in the consist;

if the fuel efficiency improvement device is not the lead fuel efficiency device:

receiving an alternative throttle notch setting from the lead fuel efficiency improvement device; and applying the alternate throttle notch setting to the locomotive power plant via the power plant interface;

if the fuel efficiency improvement device is the lead fuel efficiency improvement device:

determining via the trainline interface an operator throttle setting selected by an operator on a locomotive in the consist;

determining an operator consist power, the operator consist power being a total combined power that would result if the locomotive power plant for each locomotive in the consist were operated in accordance with the operator throttle setting;

determining alternative throttle settings for each of the locomotives in the consist using power levels and fuel consumption rates from the initialization messages, the alternative throttle settings resulting in a alternative total consist power within a threshold amount of the operator consist power and an alternative fuel consumption rate lower than a fuel consumption rate that would result if the locomotive power plant for each locomotive in the consist were operated in accordance with the operator throttle setting;

transmitting the alternative throttle notch settings via the transceiver to respective fuel efficiency devices in the consist; and applying the alternative notch setting applicable to the locomotive on which the fuel efficiency improvement device is located via the power plant interface.

9. The device of claim 8, wherein the processor selects the fuel efficiency improvement device with the lowest serial number of the fuel efficiency improvement devices in the consist as the lead fuel efficiency improvement device.

10. The device of claim 8, wherein the serial number of each fuel efficiency improvement device is included in a respective initialization message transmitted by that fuel efficiency improvement device.

11. The device of claim 8, wherein the initialization messages are transmitted between locomotives in the consist on conductors defined in a standard twenty seven pin multiple unit jumper.

12. The device of claim 11, wherein the conductors correspond to the forward and reverse signals.

13. The device of claim 8, wherein the step of determining alternative throttle settings for each of the locomotives in the consist comprises the steps of:

calculating, for each notch setting of each locomotive, using information from the initialization message received from a respective locomotive, a greedy value ratio, the greedy value ratio being a ratio of power to fuel consumption rate;

identifying a highest greedy value ratio corresponding to a power not exceeding the operator consist power by more than a threshold amount from among all greedy ratio values for all locomotives that have not been assigned an alternative notch setting;

assigning an alternative notch setting corresponding to the highest greedy value identified in the previous step to the locomotive associated with the highest greedy value identified in the previous step;

repeating the calculating, identifying and assigning steps until a total power associated with each of the alternative notch settings assigned in the assigning steps is within the threshold amount of the operator consist power; and assigning an idle notch setting to any locomotive in the consist that was not assigned an alternative notch setting associated with a highest greedy value identified in an iteration of an identifying step.

14. The device of claim 8, wherein the step of determining alternative throttle settings for each of the locomotives in the consist comprises the steps of:

identifying a locomotive having a highest possible output power not exceeding the operator consist power by more than a threshold amount from among all locomotives that have not been assigned an alternative notch setting;

assigning an alternative notch setting to the locomotive identified in the identifying step, the alternative notch setting being associated with the highest possible output power not exceeding the operator consist power by more than the threshold amount;

repeating the identifying and assigning steps until a total power associated with each of the alternative notch settings assigned in the assigning steps is within the threshold amount of the operator consist power; and assigning an idle notch setting to any locomotive in the consist that was not assigned an alternative notch setting associated with a highest possible output power not exceeding the operator consist power identified in an iteration of an identifying step.

15. The device of claim 8, wherein the transceiver is coupled to, and adapted to communicate with other fuel efficiency devices over, a trainline.

16. A method for controlling locomotive power plants on a plurality of locomotives in a consist comprising the steps of:

transmitting, from a fuel efficiency improvement device located on each locomotive in the consist, an initialization message including an identifier of the fuel efficiency improvement device, and a power level and fuel consumption rate corresponding to each power throttle setting for a respective locomotive;

determining a fuel efficiency improvement device to act as a lead fuel efficiency improvement device for all fuel efficiency improvement devices in the consist based on identifiers in the initialization messages;

determining by the lead fuel efficiency improvement device an operator throttle setting selected by an operator on a locomotive in the consist;

determining an operator consist power, the operator consist power being a total combined power that would result if the locomotive power plant for each locomotive in the consist were operated in accordance with the operator throttle setting;

determining by the lead fuel efficiency device alternative throttle settings for each of the locomotives in the consist using power levels and fuel consumption rates from the initialization messages, the alternative throttle settings resulting in an alternative total consist power within a threshold amount of the operator consist power and an alternative fuel consumption rate lower than a fuel consumption rate that would result if the locomotive power plant for each locomotive in the consist were operated in accordance with the operator throttle setting;

transmitting the alternative throttle notch settings from the lead fuel efficiency improvement device to respective fuel efficiency devices in the consist; and applying an alternative notch setting to a respective locomotive power plant by each of the fuel efficiency improvement devices in the consist.

17. A method for controlling locomotive power plants on a plurality of locomotives in a consist comprising the steps of:

transmitting, from a fuel efficiency improvement device located on each locomotive in the consist, an initialization message including an identifier of the fuel efficiency improvement device, and a power level and fuel consumption rate corresponding to each power throttle setting for a respective locomotive;

determining a fuel efficiency improvement device to act as a lead fuel efficiency improvement device for all fuel efficiency improvement devices in the consist;

determining by the lead fuel efficiency improvement device an operator throttle setting selected by an operator on a locomotive in the consist;

determining an operator consist power, the operator consist power being a total combined power that would result if the locomotive power plant for each locomotive in the consist were operated in accordance with the operator throttle setting;

determining by the lead fuel efficiency device alternative throttle settings for each of the locomotives in the consist using power levels and fuel consumption rates from the initialization messages, the alternative throttle settings resulting in an alternative total consist power within a threshold amount of the operator consist power and an alternative fuel consumption rate lower than a fuel consumption rate that would result if the locomotive power plant for each locomotive in the consist were operated in accordance with the operator throttle setting;

transmitting the alternative throttle notch settings from the lead fuel efficiency improvement device to respective fuel efficiency devices in the consist; and applying an alternative notch setting to a respective locomotive power plant by each of the fuel efficiency improvement devices in the consist;

wherein the step of determining alternative throttle settings for each of the locomotives in the consist comprises the steps of calculating, for each notch setting of each locomotive, using information from the initialization message received from a respective locomotive, a greedy value ratio, the greedy value ratio being a ratio of power to fuel consumption rate;

identifying a highest greedy value ratio corresponding to a power not exceeding the operator consist power by more than a threshold amount from among all greedy ratio values for all locomotives that have not been assigned an alternative notch setting;

assigning an alternative notch setting corresponding to the highest greedy value identified in the previous step to the locomotive associated with the highest greedy value identified in the previous step;

repeating the calculating, identifying and assigning steps until a total power associated with each of the alternative notch settings assigned in the assigning steps is within the threshold amount of the operator consist power; and assigning an idle notch setting to any locomotive in the consist that was not assigned an alternative notch setting associated with a highest greedy value identified in an iteration of an identifying step.

18. A method for controlling locomotive power plants on a plurality of locomotives in a consist comprising the steps of:

transmitting, from a fuel efficiency improvement device located on each locomotive in the consist, an initialization message including an identifier of the fuel efficiency improvement device, and a power level and fuel consumption rate corresponding to each power throttle setting for a respective locomotive;

determining a fuel efficiency improvement device to act as a lead fuel efficiency improvement device for all fuel efficiency improvement devices in the consist;

determining by the lead fuel efficiency improvement device an operator throttle setting selected by an operator on a locomotive in the consist;

determining an operator consist power, the operator consist power being a total combined power that would result if the locomotive power plant for each locomotive in the consist were operated in accordance with the operator throttle setting;

determining by the lead fuel efficiency device alternative throttle settings for each of the locomotives in the consist using power levels and fuel consumption rates from the initialization messages, the alternative throttle settings resulting in an alternative total consist power within a threshold amount of the operator consist power and an alternative fuel consumption rate lower than a fuel consumption rate that would result if the locomotive power plant for each locomotive in the consist were operated in accordance with the operator throttle setting;

transmitting the alternative throttle notch settings from the lead fuel efficiency improvement device to respective fuel efficiency devices in the consist; and applying an alternative notch setting to a respective locomotive power plant by each of the fuel efficiency improvement devices in the consist;

wherein the step of determining alternative throttle settings for each of the locomotives in the consist comprises the steps of identifying a locomotive having a highest possible output power not exceeding the operator consist power by more than a threshold amount from among all locomotives that have not been assigned an alternative notch setting;

assigning an alternative notch setting to the locomotive identified in the identifying step, the alternative notch setting being associated with the highest possible output power not exceeding the operator consist power by more than the threshold amount;

repeating the identifying and assigning steps until a total power associated with each of the alternative notch settings assigned in the assigning steps is within the threshold amount of the operator consist power; and assigning an idle notch setting to any locomotive in the consist that was not assigned an alternative notch setting associated with a highest possible output power not exceeding the operator consist power identified in an iteration of an identifying step.

19. A fuel efficiency improvement device located on a locomotive in a locomotive consist for controlling a locomotive power plant, the fuel efficiency improvement device comprising:

a processor;

a memory connected to the processor;

a transceiver connected to the processor, the transceiver being configured for communication with other fuel efficiency improvement devices; and a trainline interface connected to the processor; and a power plant interface connected to apply a throttle notch signal to the locomotive power plant;

wherein the processor is configured to perform the steps of:

transmitting an initialization message including an identifier of the fuel efficiency improvement device, and a power level and fuel consumption rate corresponding to each power throttle setting for the locomotive;

determining whether the fuel efficiency improvement device is the lead fuel efficiency improvement device for other fuel efficiency improvement devices in the consist;

if the fuel efficiency improvement device is not the lead fuel efficiency device:

receiving an alternative throttle notch setting from the lead fuel efficiency improvement device; and applying the alternate throttle notch setting to the locomotive power plant via the power plant interface;

if the fuel efficiency improvement device is the lead fuel efficiency improvement device:

determining via the trainline interface an operator throttle setting selected by an operator on a locomotive in the consist;

determining an operator consist power, the operator consist power being a total combined power that would result if the locomotive power plant for each locomotive in the consist were operated in accordance with the operator throttle setting;

determining alternative throttle settings for each of the locomotives in the consist using power levels and fuel consumption rates from the initialization messages, the alternative throttle settings resulting in a alternative total consist power within a threshold amount of the operator consist power and an alternative fuel consumption rate lower than a fuel consumption rate that would result if the locomotive power plant for each locomotive in the consist were operated in accordance with the operator throttle setting;

transmitting the alternative throttle notch settings via the transceiver to respective fuel efficiency devices in the consist; and applying the alternative notch setting applicable to the locomotive on which the fuel efficiency improvement device is located via the power plant interface;

wherein the step of determining alternative throttle settings for each of the locomotives in the consist comprises the steps of calculating, for each notch setting of each locomotive, using information from the initialization message received from a respective locomotive, a greedy value ratio, the greedy value ratio being a ratio of power to fuel consumption rate;

identifying a highest greedy value ratio corresponding to a power not exceeding the operator consist power by more than a threshold amount from among all greedy ratio values for all locomotives that have not been assigned an alternative notch setting;

assigning an alternative notch setting corresponding to the highest greedy value identified in the previous step to the locomotive associated with the highest greedy value identified in the previous step;

repeating the calculating, identifying and assigning steps until a total power associated with each of the alternative notch settings assigned in the assigning steps is within the threshold amount of the operator consist power; and assigning an idle notch setting to any locomotive in the consist that was not assigned an alternative notch setting associated with a highest greedy value identified in an iteration of an identifying step.

20. A fuel efficiency improvement device located on a locomotive in a locomotive consist for controlling a locomotive power plant, the fuel efficiency improvement device comprising:

a processor;

a memory connected to the processor;

a transceiver connected to the processor, the transceiver being configured for communication with other fuel efficiency improvement devices; and a trainline interface connected to the processor; and a power plant interface connected to apply a throttle notch signal to the locomotive power plant;

wherein the processor is configured to perform the steps of:

transmitting an initialization message including an identifier of the fuel efficiency improvement device, and a power level and fuel consumption rate corresponding to each power throttle setting for the locomotive;

determining whether the fuel efficiency improvement device is the lead fuel efficiency improvement device for other fuel efficiency improvement devices in the consist;

if the fuel efficiency improvement device is not the lead fuel efficiency device:

receiving an alternative throttle notch setting from the lead fuel efficiency improvement device; and applying the alternate throttle notch setting to the locomotive power plant via the power plant interface;

if the fuel efficiency improvement device is the lead fuel efficiency improvement device:

determining via the trainline interface an operator throttle setting selected by an operator on a locomotive in the consist;

determining an operator consist power, the operator consist power being a total combined power that would result if the locomotive power plant for each locomotive in the consist were operated in accordance with the operator throttle setting;

determining alternative throttle settings for each of the locomotives in the consist using power levels and fuel consumption rates from the initialization messages, the alternative throttle settings resulting in a alternative total consist power within a threshold amount of the operator consist power and an alternative fuel consumption rate lower than a fuel consumption rate that would result if the locomotive power plant for each locomotive in the consist were operated in accordance with the operator throttle setting;

transmitting the alternative throttle notch settings via the transceiver to respective fuel efficiency devices in the consist; and applying the alternative notch setting applicable to the locomotive on which the fuel efficiency improvement device is located via the power plant interface;

wherein the step of determining alternative throttle settings for each of the locomotives in the consist comprises the steps of identifying a locomotive having a highest possible output power not exceeding the operator consist power by more than a threshold amount from among all locomotives that have not been assigned an alternative notch setting;

assigning an alternative notch setting to the locomotive identified in the identifying step, the alternative notch setting being associated with the highest possible output power not exceeding the operator consist power by more than the threshold amount;

repeating the identifying and assigning steps until a total power associated with each of the alternative notch settings assigned in the assigning steps is within the threshold amount of the operator consist power; and assigning an idle notch setting to any locomotive in the consist that was not assigned an alternative notch setting associated with a highest possible output power not exceeding the operator consist power identified in an iteration of an identifying step.

* * * * *